US010262619B2

(12) United States Patent
Li

(10) Patent No.: US 10,262,619 B2
(45) Date of Patent: Apr. 16, 2019

(54) POWER CONTROL SYSTEM AND DISPLAY PANEL HAVING THE SAME

(71) Applicant: Shenzhen China Star Optoelectronics Technology Co., Ltd., Shenzhen, Guangdong (CN)

(72) Inventor: Yuntao Li, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 299 days.

(21) Appl. No.: 15/300,950

(22) PCT Filed: Jul. 11, 2016

(86) PCT No.: PCT/CN2016/089663
§ 371 (c)(1),
(2) Date: Sep. 30, 2016

(87) PCT Pub. No.: WO2017/197744
PCT Pub. Date: Nov. 23, 2017

(65) Prior Publication Data

US 2018/0174546 A1 Jun. 21, 2018

(30) Foreign Application Priority Data

May 20, 2016 (CN) ..... 2016 1 0338572

(51) Int. Cl.
*G09G 3/36* (2006.01)

(52) U.S. Cl.
CPC ..... *G09G 3/3696* (2013.01); *G09G 2310/08* (2013.01); *G09G 2330/021* (2013.01); *G09G 2370/14* (2013.01)

(58) Field of Classification Search
CPC ..... G09G 2370/14
See application file for complete search history.

(56) References Cited

U.S. PATENT DOCUMENTS

2011/0122166 A1* 5/2011 Peng ..... G09G 3/3648 345/690

* cited by examiner

*Primary Examiner* — Robin J Mishler
(74) *Attorney, Agent, or Firm* — Andrew C. Cheng

(57) ABSTRACT

The invention provides a display panel and a power control system of a drive circuit of the display panel. The power control system includes a timer controller, a power manager, and a drive circuit. The timer controller is used for receiving a first video signal and sending a finishing signal to the power manager after reading a decoding code for decoding the first video signal successfully. The power manager is used for sending a first drive voltage and a second drive voltage to the drive circuit after receiving the finishing signal. The power control system reduces the time difference between the video signal and the voltage, thereby avoiding the black screen problem.

12 Claims, 2 Drawing Sheets

POWER CONTROL SYSTEM AND DISPLAY PANEL HAVING THE SAME

BACKGROUND OF THE INVENTION

1. Field of the Invention

The present invention relates to a power control field, especially relates to a power control system and a display panel having the power control system.

2. Description of Related Art

Liquid crystal display televisions, which have a small size, a light weight, and an excellent display effect, are very popular to people. The circuit drive system of the display panel includes a timer controller IC (TCON IC), a driver IC, a power manager IC (PWN IC) and a programmable Gamma IC (P-Gamma IC). The TCON IC outputs video signal to the driver IC, and the power manager IC outputs voltages to the driver IC and the P-Gamma IC. The TCON IC and the power manager IC output separately and the video signal should be decoded before being outputted, which sometimes enables the time difference between the video signal outputted by the TCON IC and the voltages outputted by the power manager IC to become greater. The display panel will become a black screen, which shows to be abnormal to users.

Thus, to solve above technical problem, a power control system and a display panel having the power control system are required.

SUMMARY OF THE INVENTION

In order to overcome the deficiency of the related art, the purpose of the present disclosure is to provide a power control system and a display panel having the power control system.

The invention provides a power control system of a driving circuit of a display panel. The power control system includes a timer controller, a power manager, and a drive circuit for driving the display panel to display. The timer controller is used for receiving a first video signal and sending a finishing signal to the power manager after reading a decoding code for decoding the first video signal successfully. The power manager is used for sending a first drive voltage and a second drive voltage to the drive circuit after receiving the finishing signal.

As a further improvement of the present disclosure, the timer controller is further used for sending a second video signal and a timing control signal to the drive circuit after the decoding code decodes the first video signal.

As a further improvement of the present disclosure, the first video signal is LVDS signal, and the second video signal is mini-LVDS.

As a further improvement of the present disclosure, the drive circuit comprises a source driver IC and a gate driver IC; the source driver IC is used for receiving the mini-LVDS signal and the first drive voltage; and the gate driver IC is used for receiving the second drive voltage and the timing control signal.

As a further improvement of the present disclosure, the power control system further includes a P-gamma IC, the P-Gamma is used for outputting a gamma voltage to the source driver IC after receiving the first drive voltage sent by the power manager.

As a further improvement of the present disclosure, the first drive voltage is a VAA voltage, and the second drive voltage is a VGH voltage.

As a further improvement of the present disclosure, the timer controller further comprises a power on control pin for sending the finishing signal to the power manager.

As a further improvement of the present disclosure, the power control further includes a memory, and the decoding code is stored in the memory.

As a further improvement of the present disclosure, the timer controller is used for reading the decoding code to change the level of the power on control pin from low to high for sending the finish signal before outputting the second video signal.

Correspondingly, a display panel includes the above power control system.

The benefit of the present disclosure is: the timer controller sending a finishing signal to the power manager after reading a decoding code for decoding the first video signal successfully; the power manager sending a drive voltage to the drive circuit after receiving the finishing signal, thereby reducing the time difference between the video signal outputted by the time controller and the voltages outputted by the power manager.

DETAILED DESCRIPTION OF THE PREFERRED EMBODIMENT

The following content combines with the figures and the embodiments for describing the present invention in detail.

Figure 1:
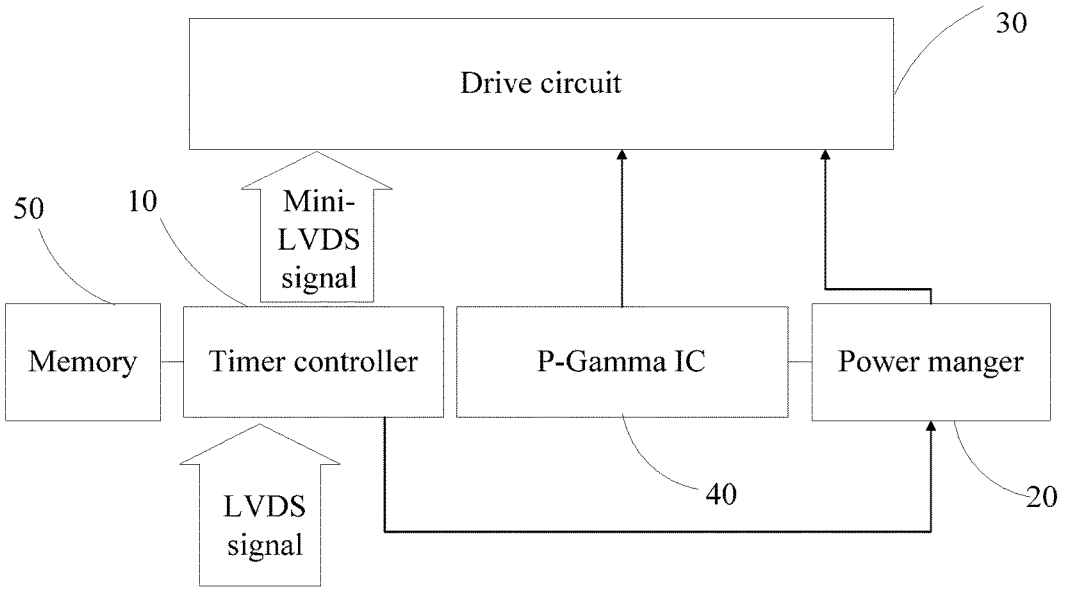
FIG. 1 is a schematic view of the power control system of the display panel according to an embodiment of the present disclosure.
Figure 2:
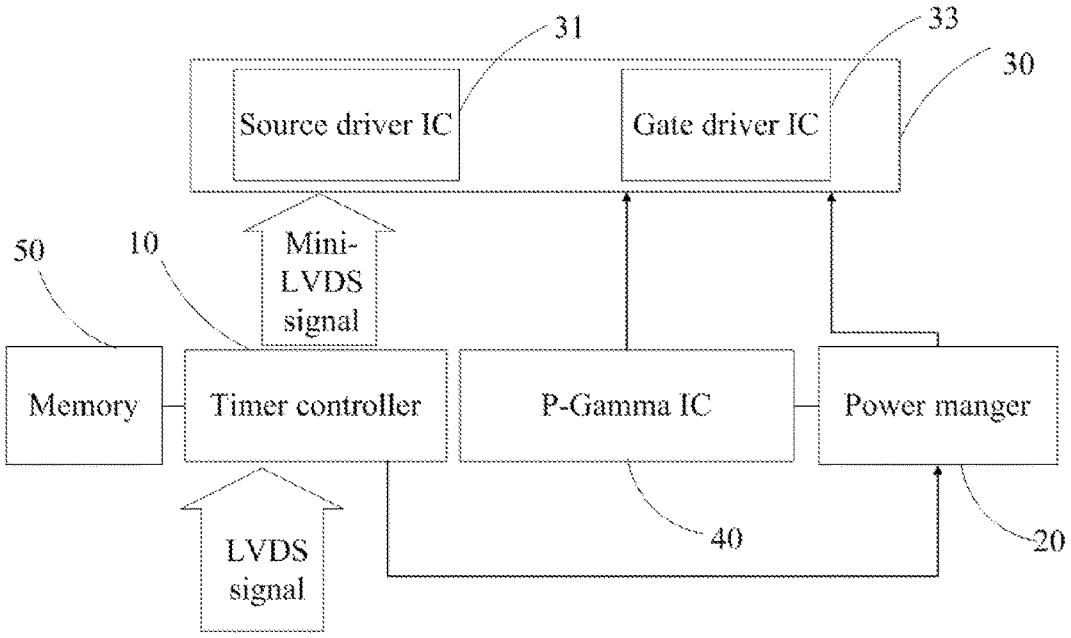
FIG. 2 is another schematic view the power control system of the display panel according to an embodiment of the present disclosure.

Referring to FIGS. 1 and 2, the power system according to an embodiment includes a timer controller 10, a power manager 20, a drive circuit 30, a P-gamma IC 40, and a memory 50. In the embodiment, the drive circuit 30 includes a source driver IC and a gate driver IC 33, and the memory 50 is erasable programmable read-only memory (EPROM). A decoding code is stored in the memory 50.

The power manager 20 provides 3.3 V to each parts timely, after being powered on, to enable each part to be on work after being powered on. In addition, the power manager 20 further provides VGL voltage to the gate driver IC 33 directly. The timer controller 10 sends a finishing signal to the power manager 20 after receiving the first video signal and reading the decoding code from the memory 50. Then the power manager 20 sends a first drive voltage and a second drive voltage to the source driver IC 31 and the gate driver IC 33 respectively. The timer controller 10 decodes the first video according the decoding code after sending the finishing signal to the power manager 20. The timer controller 10 sends a second video signal and a timing control signal to the source driver IC 31 after decoding the first video signal. In the embodiment, the first video signal is a LVDS signal, the second video signal is a mini-LVDS signal, the first drive voltage is a VAA voltage, and the second drive voltage is a VGH voltage. The P-gamma IC 30 outputs a gamma voltage to the source driver IC 31 after receiving the first drive voltage sent by the power manager 20.

The source driver IC 32 controls the display panel to display according to the timing control signal and the VGH voltage.

In particular, a power on control pin (not shown) can be designed on the timer controller 10. The timer controller 10 reads the decoding code and changes the level of the power on control pin from low to high before outputting the second video signal. The power manager 20 sends the first drive voltage and the second drive voltage to the source driver IC 31 and the gate driver IC 32 respectively after receiving the high level finishing signal. In the present disclosure, the power source of the display panel system is controlled by the timer controller 10, which ensures the video signal and the drive voltage to be outputted in sequence. Thus, it reduces the occurrence of phenomena of the related art that the time difference, between the video signal outputted by the time controller 10 and the voltages outputted by the power manager 20, is greater due to separately outputting between the video signal and the voltages.

In the embodiment, the timer controller 10 sends the finishing signal to the power manager 20 after reading the decoding code from the memory 50, and the power manager 20 sends drive voltages to the drive circuit 30 after receiving the finishing signal, thereby reducing the time difference between the video signal outputted by the time controller 10 and the voltages outputted by the power manager 20.

For the person skilled in the art, obviously, the present invention is not limited to the detail of the above exemplary embodiment. Besides, without deviating the spirit and the basic feature of the present invention, other specific forms can also achieve the present invention. Therefore, no matter from what point of view, the embodiments should be deemed to be exemplary, not limited. The range of the present invention is limited by the claims not by the above description. Accordingly, the embodiments are used to include all variation in the range of the claims and the equivalent requirements of the claims. It should not regard any reference signs in the claims as a limitation to the claims.

Besides, it can be understood that, although the present disclosure is describe according to the embodiments, each embodiment does not include only on dependent technology solution. The description of the present disclosure is only for clarity. The person skilled in the art should regard the present disclosure as an entirety. Technology solutions in the embodiments can be adequately combined to form other embodiments that can be understood by the person skilled in the art.

What is claimed is:

1. A power control system of a driving circuit of a display panel comprising a timer controller, a power manager, and a drive circuit for driving the display panel to display; the timer controller configured to receive a first video signal and to send a finishing signal to the power manager after reading a decoding code for decoding the first video signal successfully; and the power manager configured to send a first drive voltage and a second drive voltage to the drive circuit after receiving the finishing signal;

wherein a memory is connected to the timer controller, the memory storing therein the decoding code;

wherein the timer controller further comprises a power on control pin for sending the finishing signal to the power manager; and wherein the timer controller is configured to change a level of the power on control pin from low to high after reading the decoding code successfully for sending the finish signal before outputting the second video signal; and the power manager is configured to send the first drive voltage and the second drive voltage to the drive circuit after receiving the high level finishing signal.

2. The power control system according to claim 1, wherein timer controller is further configured to send a second video signal and a timing control signal to the drive circuit after the decoding code decodes the first video signal.

3. The power control system according to claim 2, wherein the first video signal is LVDS signal, and the second video signal is mini-LVDS.

4. The power control system according to claim 3, wherein the drive circuit comprises a source driver IC and a gate driver IC; the source driver IC is configured to receive the mini-LVDS signal and the first drive voltage; and the gate driver IC is configured to receive the second drive voltage and the timing control signal.

5. The power control system according to claim 4, further comprising a P-gamma IC, the P-Gamma is configured to output a gamma voltage to the source driver IC after receiving the first drive voltage sent by the power manager.

6. The power control system according to claim 1, wherein the first drive voltage is a VAA voltage, and the second drive voltage is a VGH voltage.

7. A display panel, comprising a power control system of a driving circuit, the power control system comprising a timer controller, a power manager, and a drive circuit for driving the display panel to display; the timer controller used for receiving a first video signal and send a finishing signal to the power manager after reading a decoding code for decoding the first video signal successfully; and the power manager configured to send a first drive voltage and a second drive voltage to the drive circuit after receiving the finishing signal;

wherein a memory is connected to the timer controller, the memory storing therein the decoding code;

wherein the timer controller further comprises a power on control pin for sending the finishing signal to the power manager; and wherein the timer controller is configured to change a level of the power on control pin from low to high after reading the decoding code successfully for sending the finish signal before outputting the second video signal; and the power manager is configured to send the first drive voltage and the second drive voltage to the drive circuit after receiving the high level finishing signal.

8. The display panel according to claim 7, wherein timer controller is further configured to send a second video signal and a timing control signal to the drive circuit after the decoding code decodes the first video signal.

9. The display panel according to claim 8, wherein the first video signal is LVDS signal, and the second video signal is mini-LVDS.

10. The display panel according to claim 9, wherein the drive circuit comprises a source driver IC and a gate driver IC; the source driver IC is configured to receive the mini-LVDS signal and the first drive voltage; and the gate driver IC is configured to receive the second drive voltage and the timing control signal.

11. The display panel according to claim 10, further comprising a P-gamma IC, the P-Gamma is configured to output a gamma voltage to the source driver IC after receiving the first drive voltage sent by the power manager.

12. The display panel according to claim 7, wherein the first drive voltage is a VAA voltage, and the second drive voltage is a VGH voltage.

* * * * *